US007670033B2

(12) United States Patent
Steer et al.

(10) Patent No.: US 7,670,033 B2
(45) Date of Patent: Mar. 2, 2010

(54) FIRE STOP FOR LIGHT FIXTURE

(75) Inventors: Adrian Michael Steer, Hebden Bridge (GB); Peter Tonge, Manchester (GB); John Valentine, Manchester (GB)

(73) Assignee: Tenmat Ltd. (GB)

( * ) Notice: Subject to any disclaimer, the term of this patent is extended or adjusted under 35 U.S.C. 154(b) by 0 days.

(21) Appl. No.: 11/962,728

(22) Filed: Dec. 21, 2007

(65) Prior Publication Data

US 2008/0170404 A1 Jul. 17, 2008

Related U.S. Application Data

(60) Provisional application No. 60/879,998, filed on Jan. 11, 2007.

(51) Int. Cl.
*F21V 15/00* (2006.01)

(52) U.S. Cl. ..... 362/364; 362/267; 362/365

(58) Field of Classification Search ..... 362/147, 362/267, 294, 362, 364, 365, 366, 373
See application file for complete search history.

(56) References Cited

U.S. PATENT DOCUMENTS 4,396,142 A 8/1983 Lines, Jr. et al.
5,456,050 A 10/1995 Ward
5,758,959 A 6/1998 Sieczkowski
6,105,334 A 8/2000 Monson et al.
6,357,891 B1 3/2002 Newbold et al.
6,421,968 B2 7/2002 Degelsegger
2005/0242093 A1 11/2005 Sharpe et al.
2006/0258284 A1 11/2006 Melesky
2007/0109796 A1 * 5/2007 Johnson ..... 362/373
2007/0206374 A1 9/2007 Petrakis et al.

FOREIGN PATENT DOCUMENTS

GB 2270936 A * 3/1994
GB 2415245 A * 12/2005
GB 2454449 A * 5/2009

* cited by examiner

*Primary Examiner*—Y My Quach Lee
(74) *Attorney, Agent, or Firm*—DLA Piper LLP (US)

(57) ABSTRACT

A fire stop for use with a light fixture in a suspended ceiling or wall. It prevents flames and smoke from passing through the light fixture and spreading throughout a building by moving above the ceiling or behind the walls. The fire stop has a lightweight enclosure that defines an interior space disposed above the suspended ceiling, or behind the wall. Contained within the interior space are a portion of the light fixture and a layer of intumescent material. The intumescent material forms a material with a relatively low thermal conductivity that substantially fills the interior space, impeding the movement of flames or smoke, when the intumescent material reaches at least a pre-determined activation temperature.

15 Claims, 3 Drawing Sheets

FIRE STOP FOR LIGHT FIXTURE

CROSS-REFERENCE TO RELATED APPLICATIONS

This application claims priority to U.S. Ser. No. 60/879,998 filed Jan. 11, 2007. The entire contents of that application are incorporated by reference herein.

TECHNICAL FIELD

The invention relates to devices for stopping or reducing the spread of fires through light fixtures, ceilings and walls.

BACKGROUND

Recessed lighting fixtures are disposed within a hole or trough cut into a wall or suspended ceiling. In particular, a "can" housing a light bulb is disposed within the hole or trough and the wiring is above the ceiling or behind the wall. The can has trim that covers the hole if the hole's diameter is larger than the can's.

Fires often spread through a building by passing through the light fixture or a portion of the hole and then moving through the space above the ceiling or behind the wall. The recessed light fixture itself provides little resistance to a spreading fire because it is often made from materials that conduct heat and the trim does not adequately seal the opening in the ceiling.

There are structures that attempt to prevent the fire from passing into the space above the ceiling. Such structures include a box usually made of a relatively heavy and bulky, thermally insulating material, such as compressed mineral wool or plaster board sheet rock

SUMMARY

Disclosed herein is a fire stop for use with a recessed light fixture in a ceiling or wall. According to one exemplary embodiment, the fire stop is comprised of a lightweight enclosure that defines an interior space, and within the interior space, preferably along a top portion, is a layer of intumescent material.

The fire stop may be disposed above the suspended ceiling or behind the wall such that the enclosure completely surrounds the hole in the ceiling or wall and the light fixture can is contained within the interior space.

When the intumescent material reaches at least a pre-determined activation temperature, usually, from a fire, it transforms into a material with a relatively low thermal conductivity that expands, substantially filling the interior space and thereby impeding or stopping flames and smoke from moving behind the wall or ceiling.

BRIEF DESCRIPTION OF THE DRAWINGS

For the purpose of illustration, there are shown examples in the drawings; however, it being understood, that this disclosure is not limited to the precise arrangements and instrumentalities shown.

DETAILED DESCRIPTION

Figure 1:
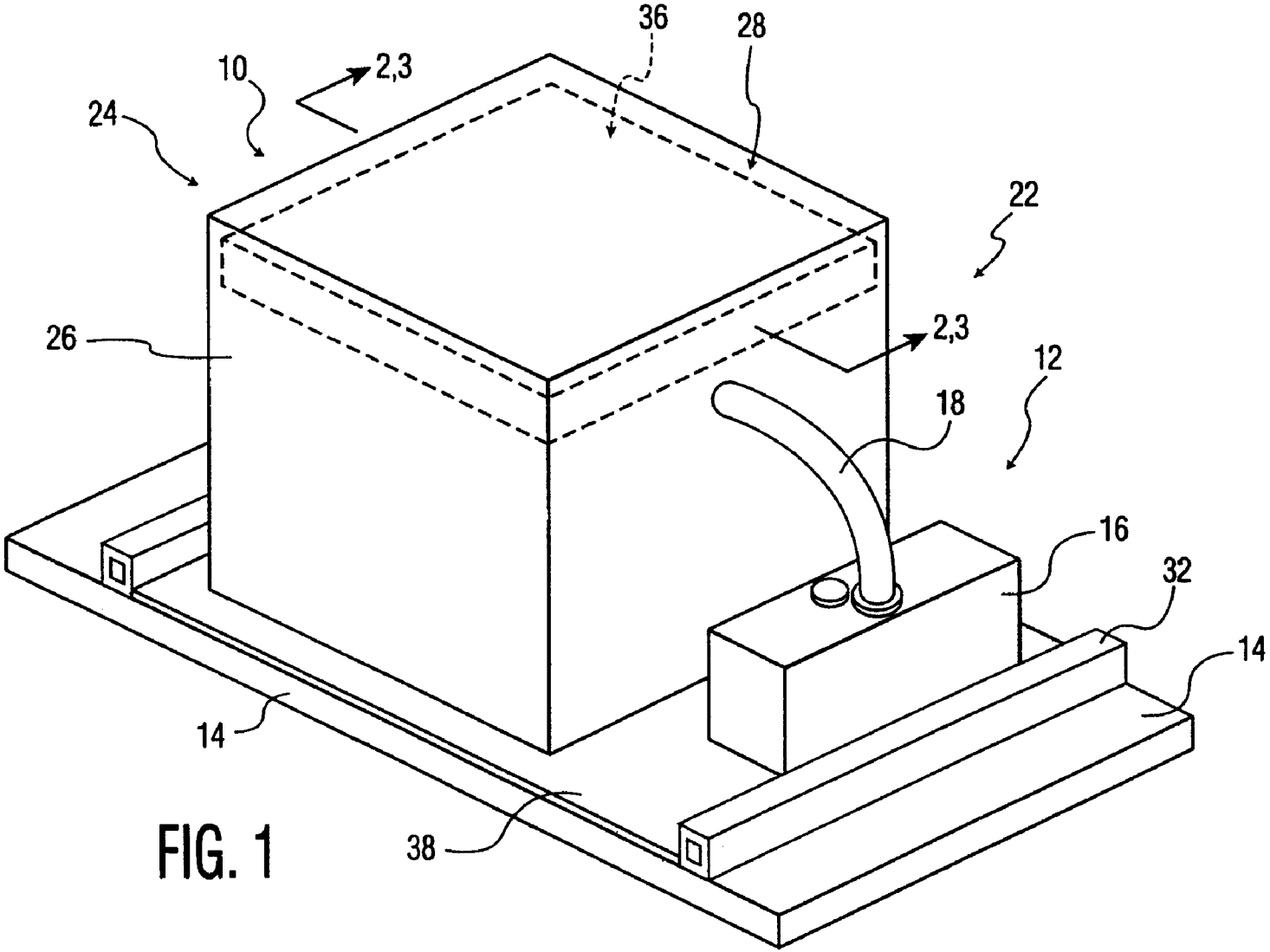
FIG. 1 is a perspective view of a fire stop according to one exemplary embodiment, used with an exemplary recessed light fixture, with the intumescent material shown in phantom.

In the figures, where like reference numerals indicate like elements, there is shown an exemplary fire stop 10 for use with an exemplary light fixture 12 in a wall or ceiling 14. For ease of illustration, the portion of the wall or ceiling 14 in which the light fixture 12 is disposed is defined herein as a "panel". The fire stop 10, as is illustrated in this example, has a generally square-shaped enclosure 24 connected to a gasket 38, an opening for feeding conduit 18 into the light fixture 12 (shown in detail in FIGS. 2 and 3) and a layer of intumescent material 36 (shown in phantom in FIG. 1) disposed along an upper wall 28. In other embodiments, the enclosure 24 may be of any desired configurations instead of being rectangular or square, and the intumescent material utilized with such enclosures may be disposed along or adjacent an upper portion of the enclosure wall.

The fire stop 10 in the present example is disposed above the ceiling 14 and in the space 22 between the ceiling 14 and the building's roof or another higher ceiling (not shown). The fire stop 10 may be disposed on or connected to ceiling joists (not shown) but in this example is attached to the ceiling or walls by support bars 32. The ceiling 14 as is illustrated herein is a suspended ceiling, but as should be understood, the fire stop may be suitable for use with other types of ceilings as well. A "suspended ceiling" includes any ceiling spaced from another higher ceiling or a building's roof, or a wall spaced from the building's exterior wall. Suspended ceilings typically include hung ceilings having joists supporting ceiling tiles made of various materials such as mineral fiber. It also includes a solid membrane ceiling made of various materials including wood, plaster, drywall, etc. It should be obvious to one of skill in the art that the aspects disclosed herein could be used in the same manner with a wall instead of a ceiling, the only difference being the means by which the enclosure is attached.

Figure 2:
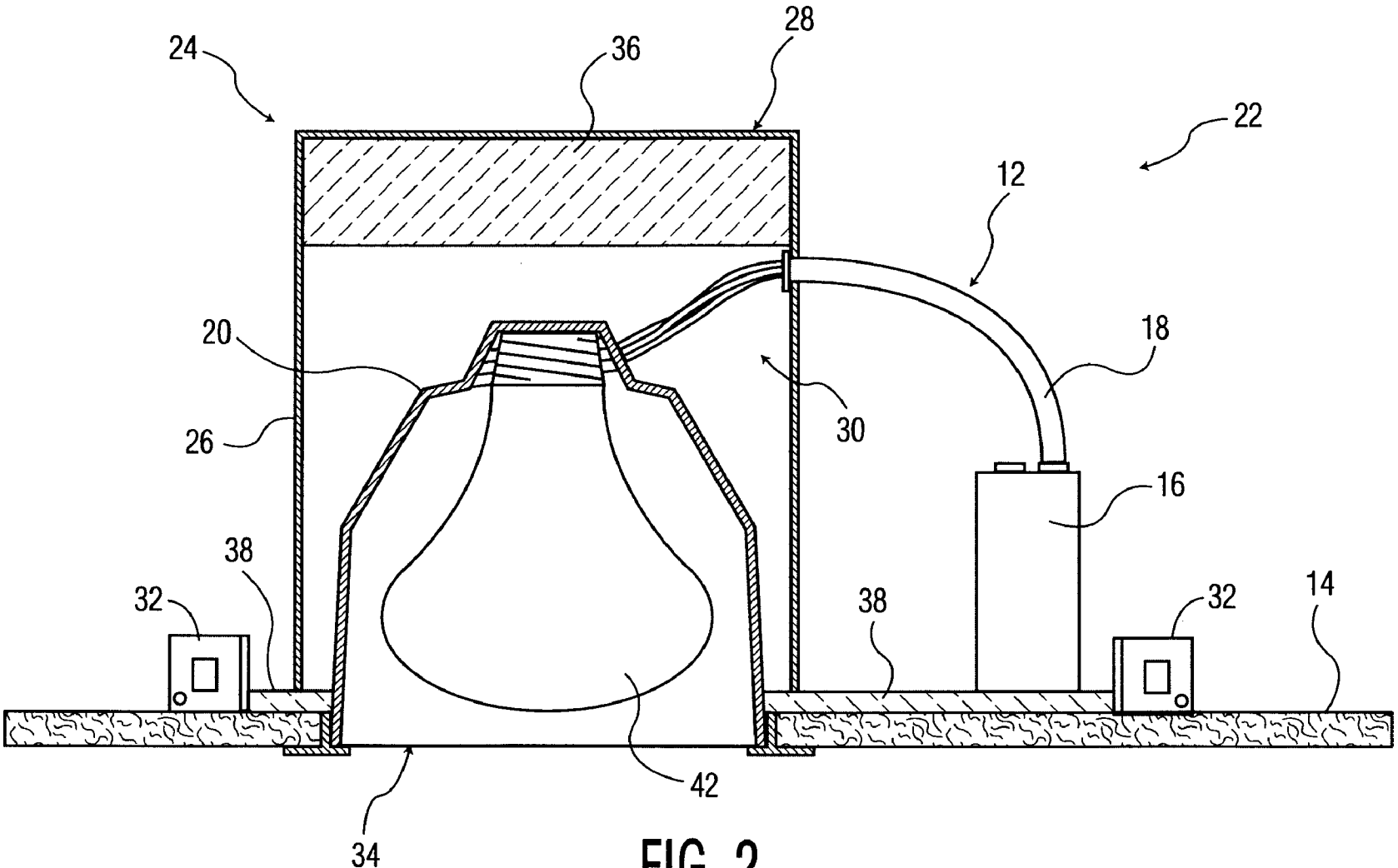
FIG. 2 is side cutaway view of the fire stop and recessed light fixture shown in FIG. 1.
Figure 3:
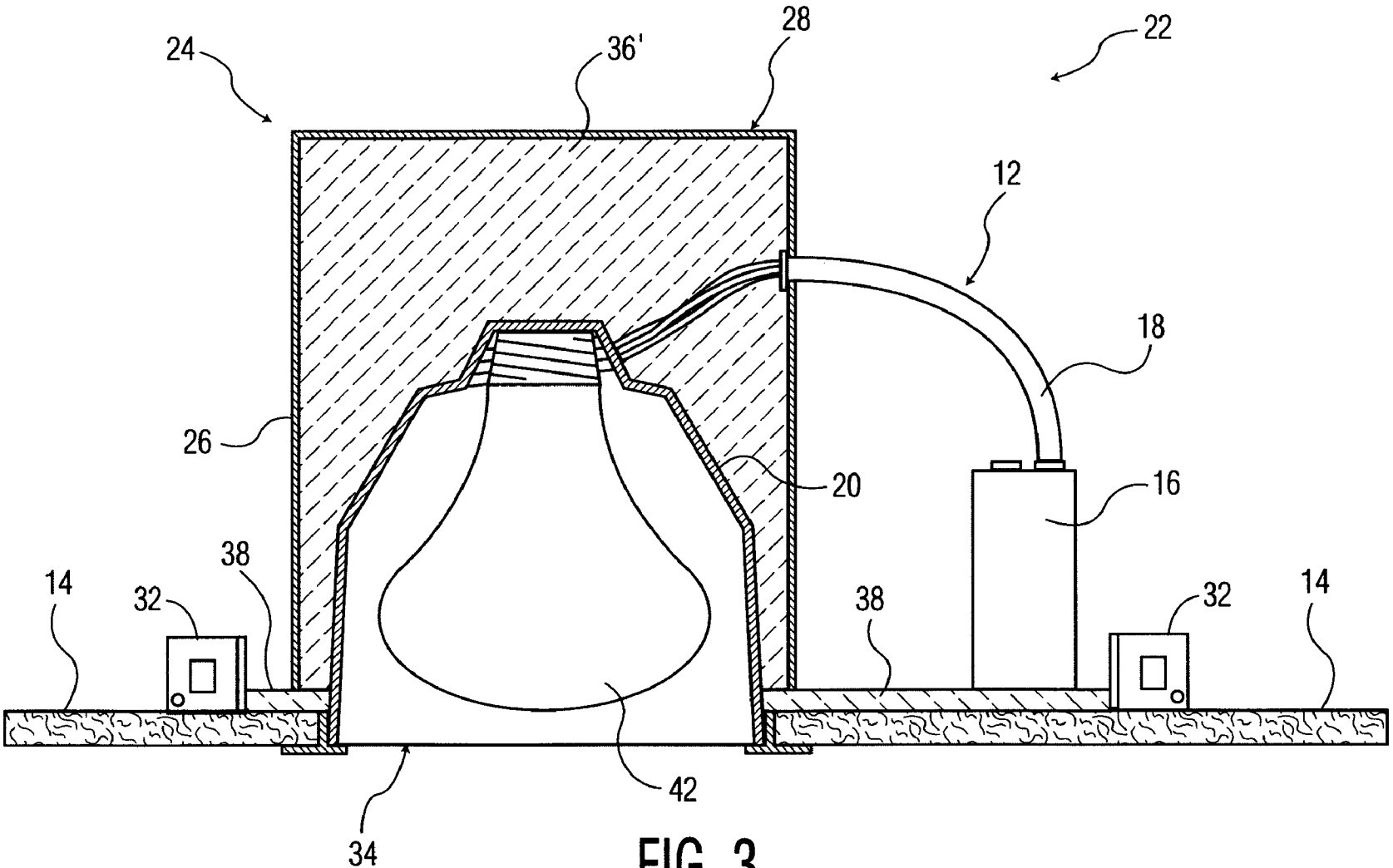
FIG. 3 is a side cutaway view of the fire stop and recessed light fixture shown in FIGS. 1 and 2 after the intumescent material has been activated.

The enclosure 24 in this example is comprised of at least one solid wall 26 and made of a lightweight material that has a high thermal conductivity, such as steel. As shown in FIGS. 1-3, the enclosure 24 has four substantially parallel, solid sidewalls and one solid upper wall 28. The sidewalls extend upward from and are substantially perpendicular to the ceiling 14. The upper wall extends substantially parallel to the ceiling 14 and substantially perpendicular to the sidewalls, thus, forming a "box" with an open bottom end. In other embodiments, the enclosure 24 may be other shapes including a cylinder, sphere, rectangular cube, cone, etc. and may include a bottom wall with a hole therein. In one embodiment, (not shown) at least one of the enclosure's walls have at least one opening (other than the opening for feeding the conduit) in communication with the interior space. In another embodiment (not shown), the enclosure's walls are made of a "mesh" material, preferably, a wire mesh. In another embodiment, (not shown) the enclosure does not fully enclose the light's can 20 on all sides. For example, the upper wall is supported by posts instead of a wall. In another embodiment (not shown), the enclosure is made entirely of an intumescent material, which is described below.

As shown in FIG. 2, the enclosure 24 creates an interior space 30. The interior space is fitted over an opening 34 in the wall or ceiling 14 so that it may contain flames, smoke or heat energy that pass through the opening 34, as described below. In one example, at least a portion of the light fixture 12, such as at least the can 20 and light bulb 42, protrude above the ceiling 14 and into the interior space 30. It should be known by one of skill in the art that the walls 26 may be modified so that the interior space can confine recessed light fixture cans of various shapes and sizes and to fit over holes of many shapes and sizes. For example, the enclosure may be sized to house elongated fluorescent light fixtures. The enclosure 24 in this example is stabilized over the light fixture 12 by its connection to support bars 32, which may be attached to the ceiling 14 or lay upon the ceiling 14. The light fixture 12 may be any light fixture known in the art and may include a junction box 16 and at least one conduit 18 for wiring the light fixture 12.

Also within the enclosure's interior space 30 in this example is one or more layers of an intumescent material 36. An intumescent material is one that swells or expands as a result of heat exposure, thus increasing in volume. The intumescent material 36 may be comprised of mineral fibers, expandable graphite and a latex binder, however, other materials may be used. As shown in FIG. 2, at least one layer of intumescent material 36 is positioned adjacent the upper wall 28 of the enclosure 24 and is disposed substantially parallel to the ceiling and substantially perpendicular to the side walls 26. In other embodiments, the least one layer of intumescent material 36 may be positioned adjacent any desired portion of the enclosure 24, such as, for example, adjacent either one, or both, of the side walls 26, which may be as an alternative to, or in addition to, upper wall 28. The intumescent material 36 may be held by any suitable means, such as a friction fit within the wall or by mechanical fastening.

As provided above, the at least one wall 26 of the enclosure 24 is preferably made of a thermally conductive material or has at least opening in addition to the opening for the conduit 18. Use of a thermally conductive material or openings in the wall 26 allows heat generated by the running light fixture 12 to more easily escape the enclosure 24, for example, by conduction through the metal or by the heat passing through the openings. Allowing this heat to more easily escape allows the light fixture 12 to "run cooler" thereby decreasing the amount of energy used, increasing the life of the light bulb 42 and decreasing the risk of overheating. The intumescent material 36 is positioned adjacent the upper wall 28 so that it does not obstruct the flow of heat from the running light fixture 12 from exiting from the sides of the enclosure 24. In addition, positioning the intumescent material 36 in the upper wall 28 of the enclosure 24 allows the overall size and weight of the enclosure 24 to be minimized. Nevertheless, in other embodiments, the intumescent material 36 may be positioned elsewhere within the interior space 30 such as along a side wall, in the corners of the enclosure, or surrounding the light can 20, as examples.

Using an enclosure comprised of materials that promote the transfer of heat from inside the enclosure is an advantage over current fire stops. As provided above, the enclosure of the presently-known fire stops are made of a fire resisting and thermally insulating material such as compressed mineral wool or sheet rock. These materials do not allow heat generated by a light fixture to easily escape from the enclosure. In addition, these known enclosures are very heavy and bulky. Because the fire stop disclosed herein may be comprised of light weight materials, it is easier to transport and set into place and produces less stress on the ceiling. In addition, providing a separate light fixture and enclosure allows embodiments of the present invention to be provided separately from the light fixture, which allows a light fixture to be installed and then the fire stop installed thereafter, avoiding having to transport and install both together.

When the intumescent material 36 reaches a certain predetermined activation temperature, for example, when it is heated due to a fire near the ceiling 14 or flames or smoke passing through the hole 34 in the ceiling 14, the intumescent material 36 forms a "char" 36' material, which has a relatively low thermal conductivity. As shown in FIG. 3, this char 36' expands filling any voids in the light fixture 12 and any voids created by the light fixture 12 in the ceiling 14, for example, the voids between the light fixture 12 and the hole 34. The char 36' forms an effective thermal and flame barrier and substantially prevents flames or smoke from passing through the enclosure 24 and into space 22. As shown in FIG. 3, in one embodiment, the intumescent material 36 substantially fills the entire interior space 30 of the enclosure 24. The portions of the lighting fixtures in the interior space 30 will be surrounded by the intumescent char 36'. The char 36' may also potentially move the light can 20 through the hole 34. The intumescent material 36 in this example is designed so that it will not "activate" during the normal running of the light fixture 12 and will only activate at a higher temperature generated by a fire. In one embodiment, the intumescent material 36 has a heat activation temperature of about 180° C. At this temperature or a greater temperature, the graphite will expand blocking the mesh with the char 36' structure. As should be understood, the intumescent material 36 in other examples may be provided having other heat activation temperatures as desired.

As shown in FIGS. 1-3, the fire stop 10 of the present example may also include a thermally insulating gasket 38 disposed between the enclosure 24 and the ceiling 14. As shown in FIGS. 2 and 3, the gasket 38 extends substantially parallel to the ceiling and preferably has an opening that fits snugly around the can 20. In certain embodiments, the gasket 38 may be about one-quarter inch thick and the grade of the material of the gasket 38 is RF1000FL, but as should be understood, the gasket 38 may also be utilized having other thickness configurations and grades of material. The gasket 38 material is commercially available from TENMAT, the assignee of the present application. The gasket 38 provides increased resistance to flames and fire and virtually ensures that there is no leakage of heat or flames during the period of activation of the intumescent layer. In other embodiments, the gasket 38 may be utilized independent of the intumescent material 36.

A variety of modifications to the embodiments described will be apparent to those skilled in the art from the disclosure provided herein. Thus, the invention may be embodied in other specific forms without departing from the spirit or essential attributes thereof and, accordingly, reference should be made to the appended claims, rather than to the foregoing specification, as indicating the scope of the invention.

What is claimed is:

1. A fire stop for use with a light fixture, the fire stop comprising:

an enclosure comprised of at least one wall having an upper portion, the at least one wall defining an interior space sized to house a can of the light fixture; and an intumescent material within the interior space of the enclosure and disposed only along the upper portion of the at least one wall, the intumescent material configured to form a material with a relatively low thermal conductivity that substantially fills the interior space of the enclosure when the intumescent material reaches at least a pre-determined activation temperature.

2. The fire stop of claim 1, wherein the enclosure comprises a plurality of sidewalls connected to an upper wall, the upper wall substantially perpendicular to the sidewalls, and the intumescent material extending only along the upper wall.

3. The fire stop of claim 2, wherein the walls have opposing faces, wherein one face faces the interior space and wherein the intumescent material is in contact with the face of the upper wall that faces the interior space.

4. The fire stop of claim 1, further comprising a thermally-insulating gasket coupled to a lower portion of the enclosure.

5. The fire stop of claim 4, wherein the gasket extends outwardly of, and substantially perpendicular to, the at least one wall.

6. The fire stop of claim 1, wherein the at least one wall of the enclosure has at least one opening in communication with the interior space and the atmosphere.

7. The fire stop of claim 1, wherein the at least one wall of the enclosure is wire mesh.

8. The fire stop of claim 1, wherein the intumescent material is comprised of: mineral fibers, expandable graphite and a latex binder.

9. A combination fire stop and light fixture used in a panel comprising a portion of a ceiling or wall, the combination comprising:

an enclosure comprised of at least one wall defining an interior space, the enclosure disposed inwardly of the panel and substantially surrounding a hole in the panel;

at least a can of a light fixture extending through the hole and disposed within the interior space, a layer of intumescent material disposed only within the enclosure but outside of the can of the light fixture, the intumescent material configured to form a material with a relatively low thermal conductivity that substantially fills the interior space when the intumescent material reaches at least a pre-determined activation temperature; and a thermally-insulating gasket disposed between the panel and the enclosure, wherein the gasket extends substantially parallel to the panel and outward of the at least one wall of the enclosure and extends within the interior space and snugly fits around the can of the light fixture.

10. The combination of claim 9, wherein the at least one wall defines an upper portion and the intumescent material is disposed along the upper portion.

11. The combination of claim 9, wherein the at least one wall of the enclosure is made of a thermally conductive material.

12. The combination of claim 9, wherein the at least one wall of the enclosure is made of wire mesh.

13. The combination of claim 9, wherein the at least one wall of the enclosure has at least one opening in communication with the interior space.

14. A fire stop for use with a light fixture, the fire stop comprising:

an enclosure comprised of at least one wall having an upper portion, the at least one wall defining an interior space sized to house a can of the light fixture;

an intumescent material within the interior space of the enclosure and disposed only along the upper portion of the at least one wall, the intumescent material configured to form a material with a relatively low thermal conductivity that substantially fills the interior space of the enclosure when the intumescent material reaches at least a pre-determined activation temperature;

a thermally-insulating gasket coupled to a lower portion of the enclosure; and wherein the gasket is disposed within the interior space and is adapted to snugly surround the light can.

15. A combination fire stop and light fixture used in a panel comprising a portion of a ceiling or wall, the combination comprising:

an enclosure comprised of at least one wall defining an interior space, the enclosure disposed inwardly of the panel and substantially surrounding a hole in the panel;

at least a can of a light fixture extending through the hole and disposed within the interior space;

a layer of intumescent material disposed only within the enclosure but outside of the can of the light fixture, the intumescent material configured to form a material with a relatively low thermal conductivity that substantially fills the interior space when the intumescent material reaches at least a pre-determined activation temperature;

a thermally-insulating gasket disposed between the panel and the enclosure; and wherein the gasket extends within the interior space and snugly fits around the can of the light fixture.

* * * * *